US007913391B1

(12) United States Patent
Eul

(10) Patent No.: US 7,913,391 B1
(45) Date of Patent: Mar. 29, 2011

(54) NAIL CLIPPER APPARATUS

(76) Inventor: Timothy Edward Eul, Morris, MN (US)

( * ) Notice: Subject to any disclaimer, the term of this patent is extended or adjusted under 35 U.S.C. 154(b) by 256 days.

(21) Appl. No.: 12/391,861

(22) Filed: Feb. 24, 2009

(51) Int. Cl.
*A45D 29/02* (2006.01)

(52) U.S. Cl. ..... 30/28; 132/75.5; D28/60

(58) Field of Classification Search ..... 30/28, 29; 132/75.4, 75.5; D28/60
See application file for complete search history.

(56) References Cited

U.S. PATENT DOCUMENTS

| | | | | | |
|---|---|---|---|---|---|
| 898,808 | A | * | 9/1908 | Wilcox | 132/75.5 |
| 2,960,766 | A | * | 11/1960 | Whittle | 30/28 |
| 2,970,376 | A | * | 2/1961 | Sheng | 30/28 |
| D192,590 | S | * | 4/1962 | Leopoldi | D28/60 |
| 3,812,868 | A | * | 5/1974 | Keating | 132/75.4 |
| 4,062,109 | A | * | 12/1977 | Min | 30/28 |
| 4,196,514 | A | * | 4/1980 | Merriman | 30/28 |
| D266,480 | S | * | 10/1982 | Reel | D8/40 |
| 4,860,448 | A | * | 8/1989 | Husain | 30/28 |
| 4,982,747 | A | | 1/1991 | Shah | |
| 5,226,849 | A | * | 7/1993 | Johnson | 30/28 |
| 5,918,375 | A | * | 7/1999 | Rossi, III | 33/485 |
| D413,412 | S | | 8/1999 | Chiu | |
| 5,983,498 | A | * | 11/1999 | Lieberman et al. | 30/28 |
| D446,352 | S | * | 8/2001 | Grayson | D28/60 |
| D448,523 | S | * | 9/2001 | Kramer | D28/60 |
| D498,333 | S | * | 11/2004 | Di Bitonto et al. | D28/60 |
| 7,194,806 | B2 | * | 3/2007 | Kuzuu | 30/28 |
| D584,453 | S | * | 1/2009 | Rollo et al. | D28/60 |
| 2007/0017096 | A1 | * | 1/2007 | Shackelford | 30/28 |
| 2010/0071213 | A1 | * | 3/2010 | Kim | 30/28 |

* cited by examiner

*Primary Examiner* — Hwei-Siu C Payer
(74) *Attorney, Agent, or Firm* — Crossley Patent Law; Mark A. Crossley

(57) ABSTRACT

A nail clipper apparatus formed of thick steel and having a broad textured contoured handle lever providing a slip-free surface which substantially conforms to a user's thumb and which is at angle an angle to an upper arm in a range of about 0 to 30 degrees thereby increasing gripping capacity, an aperture accommodating passage of a chain therethrough and also providing a nail file. The nail clipper may also provide a curved nail length determining gauge member as a depth stop feature provided in range of predefined increments thereby accommodating a desired nail length trimming position.

13 Claims, 5 Drawing Sheets

NAIL CLIPPER APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of nail clippers are known in the prior art. Prior art patents provide a nail clipper with a depth gauge which determines the length of the nail being cut, as well as a nail clipper with an anti-tilt lever and various nail depth trimming positions. Another patent teaches a nail clipper with two cutting members and a lever arm that having an angled portion used for leverage. However, what is needed is a nail clipper apparatus formed of thick steel and having a broad textured contoured handle lever providing a slip-free surface which substantially conforms to a user's thumb thereby increasing gripping capacity, a broad base for more substantial working surface, an aperture accommodating passage of a chain therethrough to facilitate portability and also providing a nail file. The nail clipper may also provide a curved nail length determining gauge member as a depth stop feature provided in range of predefined increments.

FIELD OF THE INVENTION

The present invention relates to nail care, and more particularly, to a nail clipper apparatus which makes cutting a nail to a desired length easier due to its broad textured contoured handle lever and its broad base and as well as the angle between an upper arm and the handle lever, and curved depth stop and which also provides a nail file.

SUMMARY OF THE INVENTION

The present nail clipper apparatus is formed of thick steel and has a broad textured contoured handle lever providing a slip-free surface which substantially conforms to a user's thumb, which is larger than handle levers on conventional nail clippers, and providing a handle lever disposed at an angle to an upper arm in a range of about 0 to 30 degrees, thereby increasing gripping capacity, a broad base for more substantial working surface, a pair of complementary beveled, sharp-edged cutting jaws, an aperture accommodating passage of a chain therethrough to facilitate portability and further includes a nail file. The present nail clipper may also include a curved nail length determining depth stop feature provided in range of predefined increments The instant nail clipper apparatus enables an individual to more accurately and precisely clip fingernails and toenails due to the increased thickness of the handle lever and the increased gripping capabilities as well as the design of the cutting jaws. The present nail clipper is also designed to reduce movement from side-to-side during use as often experienced in using traditional nail clippers. With the increased ease of use, also comes savings in time and effort. The present nail clipper also assists individuals who have arthritis or similar debilitating health problems to quickly and easily cut fingernails and toenails due to the increased size and gripping capacity. One embodiment also features a five-star raised contour on the handle lever further decreasing the potential for slippage.

Thus has been broadly outlined the more important features of the present nail clipper apparatus and method so that the detailed description thereof that follows may be better understood and in order that the present contribution to the art may be better appreciated.

Numerous objects, features and advantages of the present nail clipper apparatus will be readily apparent to those of ordinary skill in the art upon reading the following detailed description of presently preferred, but nonetheless illustrative, examples of the present nail clipper apparatus and method when taken in conjunction with the accompanying drawings. In this respect, before explaining the current examples of the present nail clipper apparatus and method in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the nail clipper apparatus and method. It is therefore important that the claims be regarded as including such equivalent constructions insofar as they do not depart from the spirit and scope of the present invention.

Objects of the present nail clipper apparatus and method, along with various novel features that characterize the invention are particularly pointed out in the claims forming a part of this disclosure. For better understanding of the nail clipper apparatus and method, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
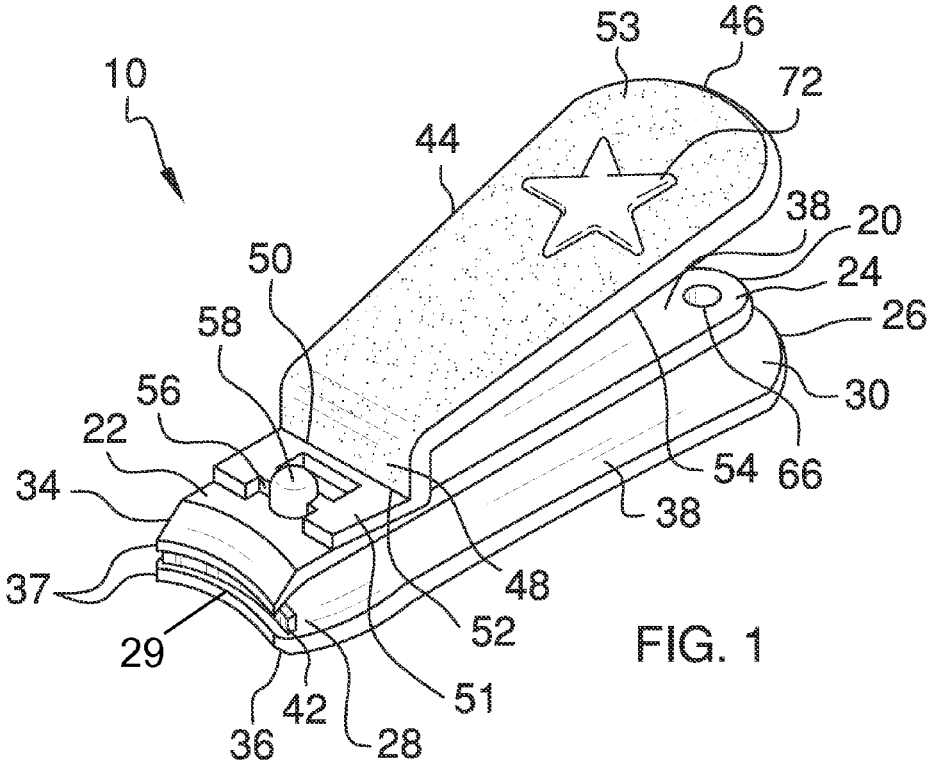
FIG. 1 is a front isometric view.
Figure 2:
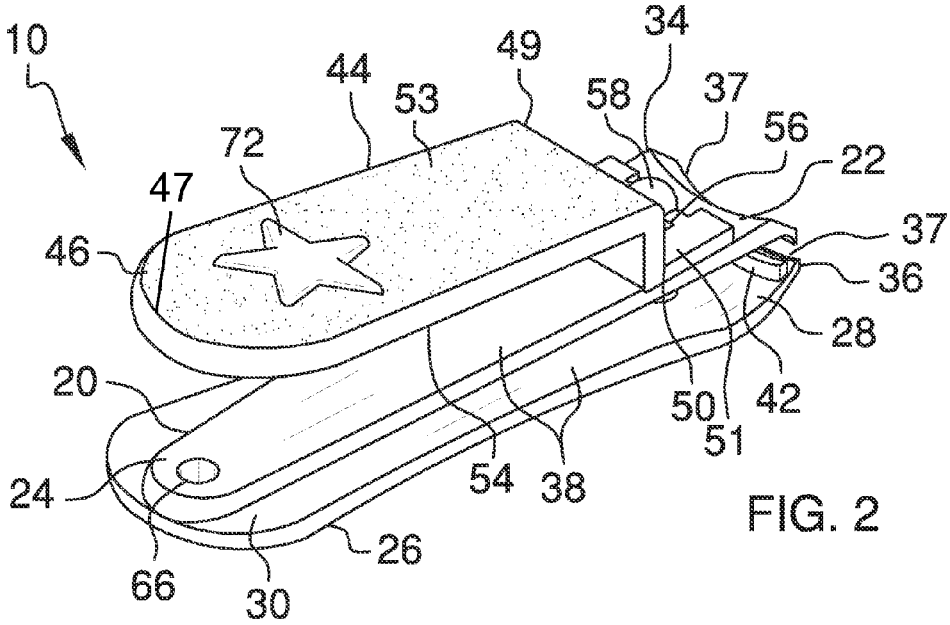
FIG. 2 is a rear isometric view.
Figure 3:
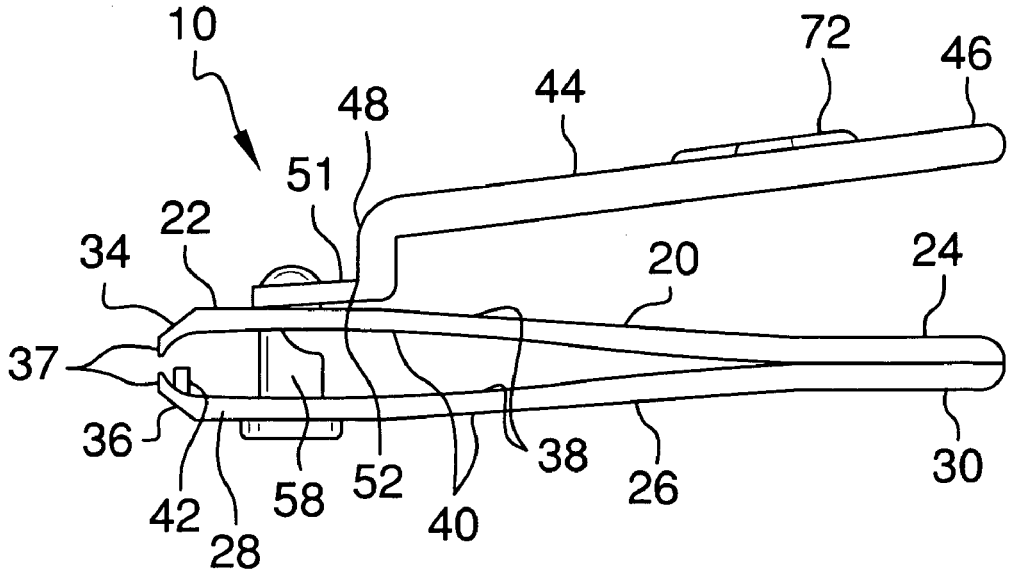
FIG. 3 is a side elevation view.
Figure 4:
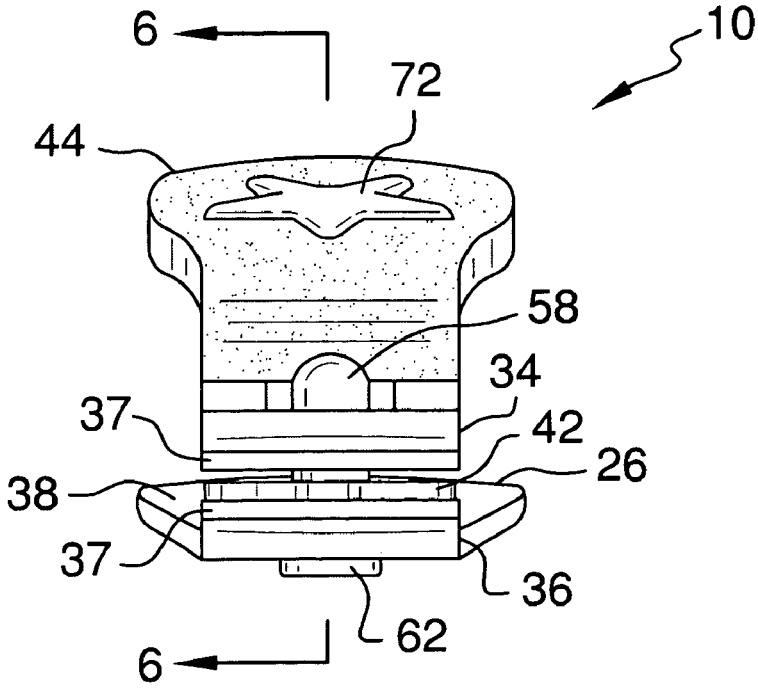
FIG. 4 is a front elevation view.
Figure 5:
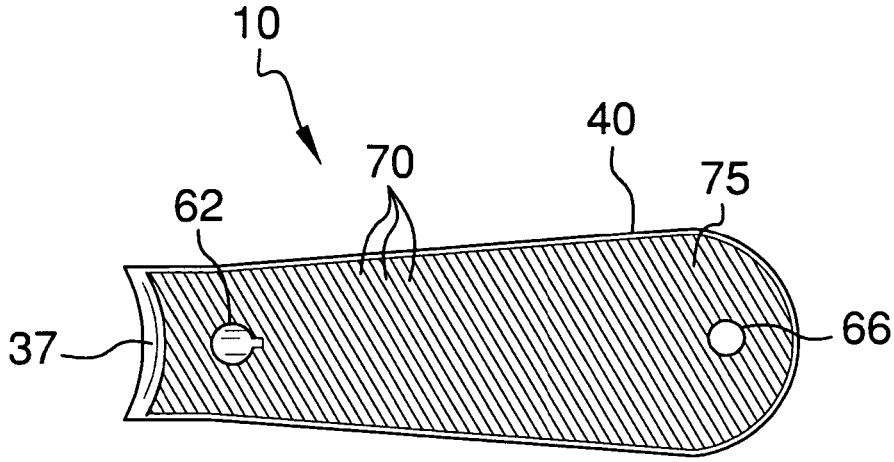
FIG. 5 is a bottom elevation view.
Figure 6:
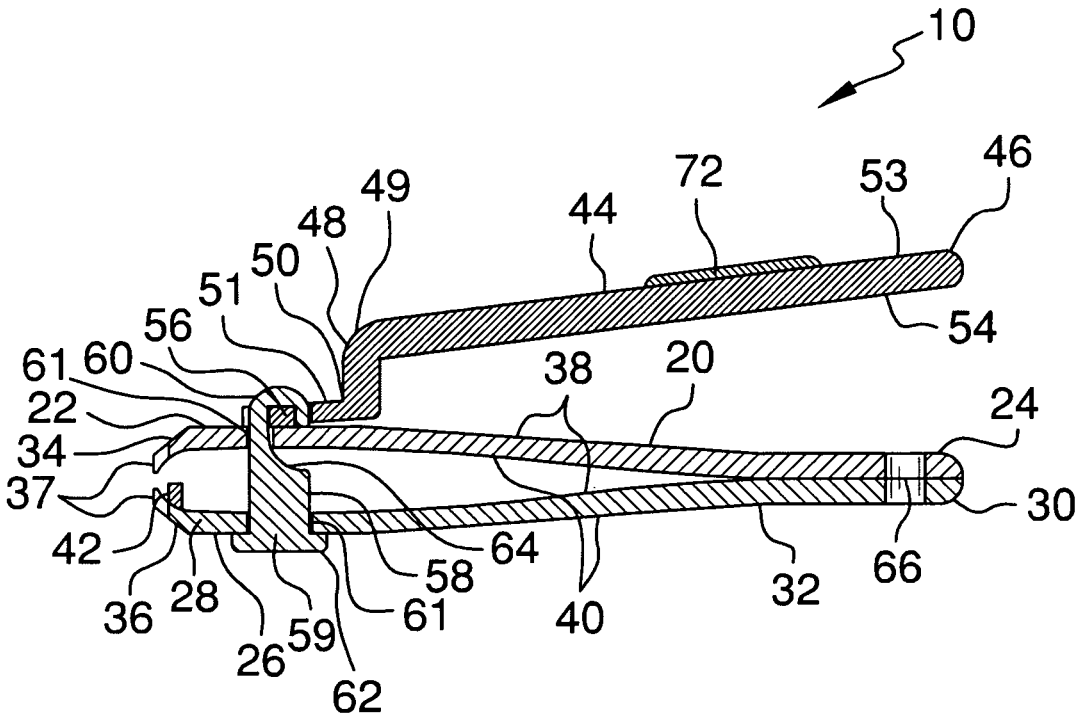
FIG. 6 is a cross-section view taken along line 6-6 of FIG. 4.

With reference now to the drawings, and in particular FIGS. 1 through 8 thereof, example of the instant nail clipper apparatus employing the principles and concepts of the present nail clipper apparatus and generally designated by the reference number 10 will be described.

Referring to FIGS. 1 through 6 and 8, one embodiment of the present nail clipper apparatus 10 is illustrated. The nail clipper 10 has generally mirror image arms comprising an upper arm 20 and a lower arm 26. The upper arm 20 has a front end 22 and a rear end 24. The lower arm 26 has a forward end 28 and a rearward end 30. The upper arm 20 and the lower arm 26 are conjoined at a connection point 32 between the rear end 24 and the rearward end 30. On the front end 22 and forward end 28 of the upper arm 20 and lower arm 26, respectively, each arm 20, 26 has a complementary upper cutting jaw member 34 and lower cutting jaw member 36, respectively. Each of the upper arm 20 and the lower arm 26 has an upper side 38 and an underside 40. Each of the upper cutting jaw member 34 and the lower cutting jaw member 36 has a cutting edge 37, the cutting edge 37 of each cutting jaw member 34, 36 facing toward one another and spaced apart so as to receive therebetween a fingernail 85 or a toenail (not shown). The cutting edges 37 are beveled. Further, an s-shaped handle lever 44, which is pivotally connected by means of a terminal force transmission crossbar 56 to a connecting pin 58 which extends oscillatably through aligned holes 61 in the arms 20, 26, operationally engages the cutting edges 37. The unitary handle lever 44 has an elongated, spatular rear portion 46, a substantially parallelepiped mid-portion 48, a substantially parallelepiped front portion 51, a top side 53, and a bottom side 54. The mid-portion 48 has a first edge 49 and an opposite second edge 50. The rear portion 46 is rounded, gently narrows toward the mid-portion first edge, and is substantially perpendicular to the mid-portion 48. The rear portion 46 substantially conforms to the size and shape of an average human thumb to prevent slippage of a thumb from the nail clipper 10 during use. The mid-section 48 is disposed at about a 90 degree angle to the upper arm 20 thereby making the handle lever 44 easier for a user to depress than a conventional nail clipper. Thus, the angle between the upper arm 20 and the handle lever 44 is preferably within the range of about 0 to 30 degrees when in a working position. The front portion 51 has a rear edge 52 which connects to the mid-portion 48 second edge 50. The front portion 51 is parallel to the rear portion 46. The connecting pin 58 has a lower end 59 and an upper end 60. The pin 58 lower end 59 has a flange 62 which retains the pin 58 in position at the lower end, while the upper end 60 of the pin 58 projects above the upper arm 20 and has a hooked recess 64 in which the crossbar 56 is engaged thereby retaining the handle lever 44 and pin 58 assembled with the arms 20, 26. The handle lever 44 rotationally and pivotally engages the pin 58 whereby the nail clipper 10 is placed into a working position and a closed position. In working position, the angle between the upper arm 20 and the handle lever 44 is in a range of about 0 to 30 degrees and the mid-portion 48 second edge 50 forms a fulcrum wherein the handle lever 44 selectively forces the upper cutting jaw member 34 to contact the lower cutting jaw member 36.

The handle lever 44 top side 53 is completely textured. The texture may be in the form of a sandblasted surface. A raised contour 72 may be disposed near a rearward edge 47 of the handle lever 44 top side 53 rear portion 46. The raised contour 72 is designed to provide a user with increased gripping capability. The raised contour 72 is convex and is provided in a variety of shapes which may include a 5-star appearance as illustrated in the drawings or in the form of a triangle or any other desired shape.

A nail file 75 is disposed on and covers the entire underside 40 of the lower arm 26. The nail file 75 is formed of plurality of parallel equidistantly positioned grooves 70 running continuously diagonally across the underside 40 of the lower arm 26.

A round aperture 66 runs continuously through the upper arm 20 rear end 24 and the lower arm 26 rearward end 30. The aperture 66 accommodates passage of a chain therethrough to facilitate portability the present apparatus 10 to be attached to key chain for easy portability and convenient access.

The present nail clipper may include a gauge member 42 as shown in FIGS. 1 through 6 and 8. The substantially parallelepiped gauge member 42 follows the curvature of the cutting jaw members 34, 36. The gauge member 42 is disposed on the upper side 38 of the lower arm 26 near an outside edge 29 of the forward end 28 and substantially transverses the width of the forward end 28. The gauge member 42 is disposed in a range of widths away from the outside edge 29 thereby allowing selection of a nail clipper 10 which accommodates a desired nail length trimming position.

Figure 7:
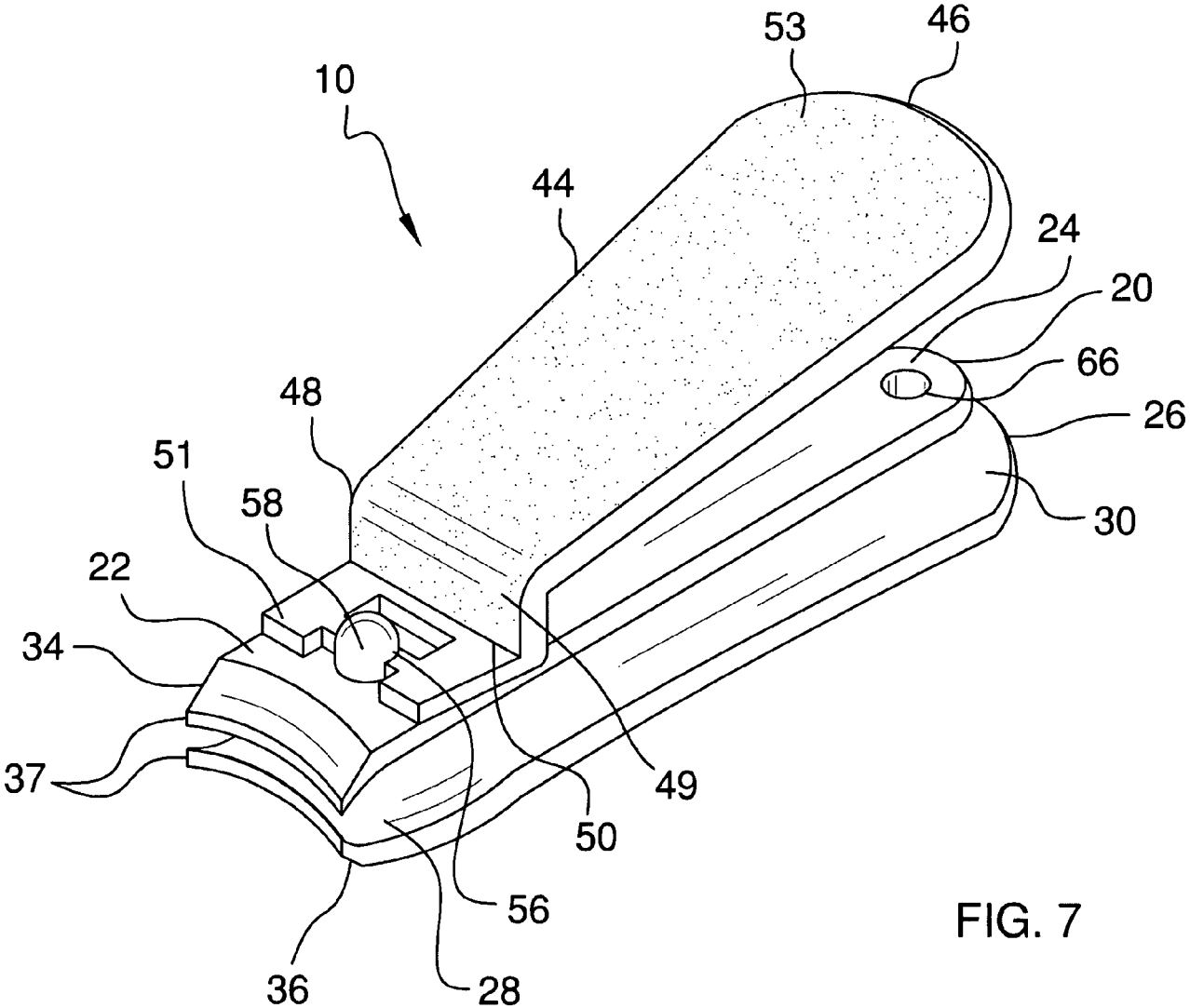
FIG. 7 is a front isometric view of another embodiment.
Figure 8:
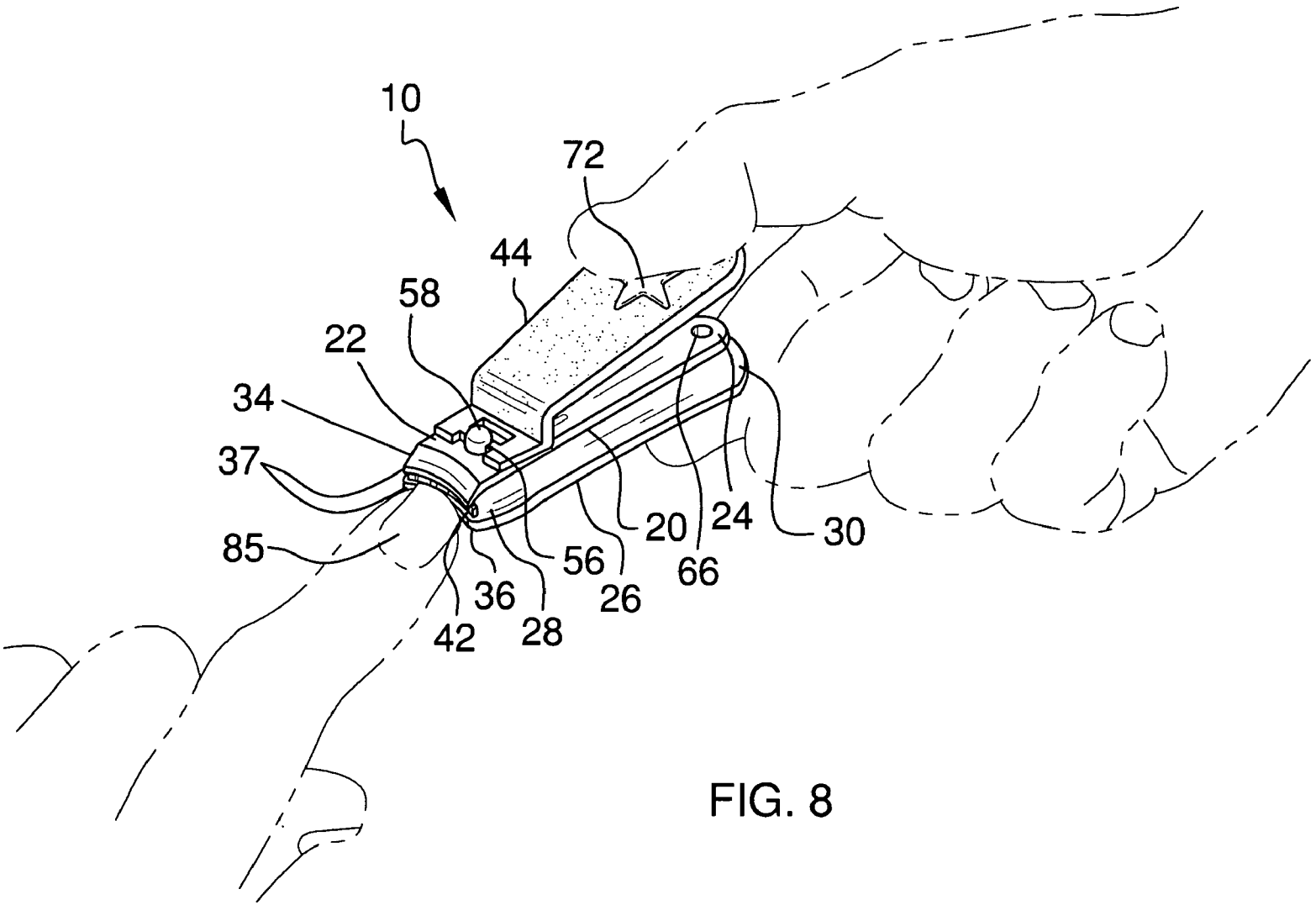
FIG. 8 is a front isometric in-use view.

Another embodiment of the present nail clipper 10, which is identical to the above-described embodiment but without the raised contour 72 and gauge member 42 is illustrated in FIG. 7.

The present nail clipper 10 is provided in a variety of dimensions. The thickness of the handle lever 44, however, is integral to the structure and functionality of the present nail clipper 10 in that the thickness provides the proper angles to allow the handle lever 44 to form a fulcrum to press the upper cutting jaw member 34 against the lower cutting jaw member 36 with sufficient force for a precise cut. The thickness of the handle lever 44 is preferably 3/32". Further, the handle lever 44 is preferably constructed of stainless steel. The perimeter of each of the upper arm 20, lower arm 26, and the handle lever 44 of the nail clipper 10 is slightly rounded for safety. The aperture 66 has a diameter of approximately 1/8" and is approximately 1/4" from the back edge of the upper arm 20 rear end 24 and the lower arm 26 rearward end 30. The diameter of each hole 61 is approximately 3/16". The width of the rear portion 46 of the handle lever 44 near the rearward edge 47 is approximately 3/4" with the width of the handle lever 44 gradually diminishing to approximately 5/8" as the handle lever 44 approaches connection with the first edge 49 of the mid-portion 48. The length of the entire nail clipper 10 is approximately 2 1/4". The gauge member 42 is disposed in increasing intervals in a range of approximately 1/32" to 1/8" away from the outside edge 29 of the lower arm 26. The intervals preferably 1/32", 3/64", 1/16", 3/32", and 1/8" away from the outside edge 29 of the lower arm 26. The gauge member 42 is formed of 1/16" thick stainless steel having a height of approximately 1/8".

With respect to the above description then, it is to be realized that the optimum dimensional relationships for the parts of the present nail clipper apparatus to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A nail clipper apparatus comprising:

a pair of arms comprising an upper arm having a front end and a rear end, and a lower arm having a forward end and a rearward end, the upper arm and the lower arm conjoined at a connection point between the rear end and the rearward end, each of the upper arm and the lower arm having an upper side and an underside;

a complementary upper cutting jaw member and a lower cutting jaw member on the upper arm front end and the lower arm forward end, respectively, each of the upper cutting jaw member and the lower cutting jaw member having a beveled cutting edge, the cutting edge of each cutting jaw member facing toward one another and spaced apart so as to receive therebetween a fingernail;

a unitary s-shaped handle lever completely textured and pivotally connected by means of a terminal force transmission crossbar to a connecting pin which extends oscillatably through aligned holes in the arms, the handle lever operationally engaging the upper arm, the handle lever comprising:

an elongated, rounded spatular rear portion substantially conforming to a human thumb size and shape;

a substantially parallelepiped mid-portion having a first edge and an opposite second edge, the rear portion narrowing toward the mid-portion first edge and substantially perpendicular to the mid-portion;

a substantially parallelepiped front portion having a rear edge connected to the mid-portion second edge and parallel to the rear portion;

a top side;

a bottom side;

wherein the size and shape of the rear portion prevent slippage of a human thumb from the nail clipper apparatus during use;

the connecting pin having a lower end and an upper end, the pin lower end having a flange retaining the pin in position at the lower end, the pin upper end projecting above the upper arm and having a hooked recess in which the crossbar is engaged thereby retaining the handle lever and the pin assembled with the arms; the handle lever rotationally and pivotally engaging the pin whereby the nail clipper apparatus is placed into a working position and a closed position;

wherein, in working position, the angle between the upper arm and the handle lever is in a range of about 0 to 30 degrees and the mid-portion second edge forms a fulcrum whereby the handle lever selectively forces the upper cutting jaw member to contact the lower cutting jaw member.

2. The nail clipper apparatus of claim 1 further comprising a nail file disposed on and covering the entire underside of the lower arm, the nail file comprising a plurality of parallel equidistantly positioned grooves running continuously diagonally across the underside of the lower arm.

3. The nail clipper apparatus of claim 1 further comprising a round aperture running continuously through the upper arm rear end and the lower arm rearward end.

4. The nail clipper apparatus of claim 3 wherein the aperture has a diameter of approximately ⅛" and is approximately ¼" from the back edge of the upper arm rear end and the lower arm rearward end.

5. The nail clipper apparatus of claim 1 further comprising a substantially parallelepiped gauge member following the curvature of the cutting jaw members, the gauge member disposed on the lower arm upper side near an outside edge of the forward end, substantially transversing the width of the forward end, and raised slightly above the lower arm upper side.

6. The nail clipper apparatus of claim 5 wherein the gauge member is formed of stainless steel having a thickness of 1/16" and a height of approximately ⅛".

7. The nail clipper apparatus of claim 1 wherein the perimeter of each of the upper arm, the lower arm, and the handle lever of the nail clipper apparatus is slightly rounded.

8. The nail clipper apparatus of claim 1 wherein the diameter of each hole is approximately 3/16";

wherein the width of the rear portion of the handle lever near a rearward edge of the handle lever is approximately ¾" and the width of the handle lever gradually diminishes to approximately ⅝" as the handle lever approaches connection with the first edge of the mid-portion; and wherein the length of the entire nail clipper apparatus is approximately 2¼".

9. The nail clipper apparatus of claim 1 further comprising a raised contour disposed near a rearward edge of the handle lever top side rear portion, wherein the raised contour increases gripping capability.

10. The nail clipper apparatus of claim 9 wherein the raised contour is 5-star shaped.

11. The nail clipper apparatus of claim 9 wherein the raised contour is triangular shaped.

12. A nail clipper apparatus comprising:

a pair of arms comprising an upper arm having a front end and a rear end, and a lower arm having a forward end and a rearward end, the upper arm and the lower arm conjoined at a connection point between the rear end and the rearward end, each of the upper arm and the lower arm having an upper side and an underside;

a complementary upper cutting jaw member and a lower cutting jaw member on the upper arm front end and the lower arm forward end, respectively, each of the upper cutting jaw member and the lower cutting jaw member having a beveled cutting edge, the cutting edge of each cutting jaw member facing toward one another and spaced apart so as to receive therebetween a fingernail;

a unitary s-shaped handle lever completely textured and pivotally connected by means of a terminal force transmission crossbar to a connecting pin which extends oscillatably through aligned holes in the arms, the handle lever operationally engaging the upper arm, the handle lever comprising:

an elongated, rounded spatular rear portion substantially conforming to a human thumb size and shape;

a substantially parallelepiped mid-portion having a first edge and an opposite second edge, the rear portion narrowing toward the mid-portion first edge and substantially perpendicular to the mid-portion;

a substantially parallelepiped front portion having a rear edge connected to the mid-portion second edge and parallel to the rear portion;

a top side;

a bottom side;

wherein the size and shape of the rear portion prevent slippage of a human thumb from the nail clipper apparatus during use;

the connecting pin having a lower end and an upper end, the pin lower end having a flange retaining the pin in position at the lower end, the pin upper end projecting above the upper arm and having a hooked recess in which the crossbar is engaged thereby retaining the handle lever and the pin assembled with the arms; the handle lever rotationally and pivotally engaging the pin whereby the nail clipper apparatus is placed into a working position and a closed position;

wherein, in working position, the angle between the upper arm and the handle lever is in a range of about 0 to 30 degrees and the mid-portion second edge forms a fulcrum whereby the handle lever selectively forces the upper cutting jaw member to contact the lower cutting jaw member;

a raised contour disposed near a rearward edge of the handle lever top side rear portion, wherein the raised contour increases gripping capability.

13. A nail clipper apparatus comprising:

a pair of arms comprising an upper arm having a front end and a rear end, and a lower arm having a forward end and a rearward end, the upper arm and the lower arm conjoined at a connection point between the rear end and the rearward end, each of the upper arm and the lower arm having an upper side and an underside;

a complementary upper cutting jaw member and a lower cutting jaw member on the upper arm front end and the lower arm forward end, respectively, each of the upper cutting jaw member and the lower cutting jaw member having a beveled cutting edge, the cutting edge of each cutting jaw member facing toward one another and spaced apart so as to receive therebetween a fingernail;

a unitary s-shaped handle lever completely textured and pivotally connected by means of a terminal force transmission crossbar to a connecting pin which extends oscillatably through aligned holes in the arms, the handle lever operationally engaging the upper arm, the handle lever comprising:

an elongated, rounded spatular rear portion substantially conforming to a human thumb size and shape;

a substantially parallelepiped mid-portion having a first edge and an opposite second edge, the rear portion narrowing toward the mid-portion first edge and substantially perpendicular to the mid-portion;

a substantially parallelepiped front portion having a rear edge connected to the mid-portion second edge and parallel to the rear portion;

a top side;

a bottom side;

wherein the size and shape of the rear portion prevent slippage of a human thumb from the nail clipper apparatus during use;

the connecting pin having a lower end and an upper end, the pin lower end having a flange retaining the pin in position at the lower end, the pin upper end projecting above the upper arm and having a hooked recess in which the crossbar is engaged thereby retaining the handle lever and the pin assembled with the arms; the handle lever rotationally and pivotally engaging the pin whereby the nail clipper apparatus is placed into a working position and a closed position;

wherein, in working position, the angle between the upper arm and the handle lever is in a range of about 0 to 30 degrees and the mid-portion second edge forms a fulcrum whereby the handle lever selectively forces the upper cutting jaw member to contact the lower cutting jaw member;

a raised contour disposed near a rearward edge of the handle lever top side rear portion, wherein the raised contour increases gripping capability;

a substantially parallelepiped gauge member following the curvature of the cutting jaw members, the gauge member disposed on the lower arm upper side near an outside edge of the forward end, substantially transversing the width of the forward end, and raised slightly above the lower arm upper side; and a round aperture running continuously through the upper arm rear end and the lower arm rearward end.

* * * * *